United States Patent [19]

Germann

[11] 3,997,273

[45] Dec. 14, 1976

[54] BALLPOINT PEN CARTRIDGE

[75] Inventor: Werner Germann, Lugano-Cassarate, Switzerland

[73] Assignee: Ananda Anlageanstalt, Vaduz, Liechtenstein

[22] Filed: June 18, 1973

[21] Appl. No.: 370,738

[52] U.S. Cl. ..... 401/190

[51] Int. Cl.[2] ..... B43K 7/08

[58] Field of Search ..... 401/187, 190; 222/394

[56] References Cited

UNITED STATES PATENTS

| | | | |
|---|---|---|---|
| 3,282,255 | 11/1966 | Killen | 401/187 |
| 3,425,779 | 2/1969 | Fisher et al. | 401/190 |
| 3,775,015 | 11/1973 | Tsunoda et al. | 401/190 |

FOREIGN PATENTS OR APPLICATIONS

| | | | |
|---|---|---|---|
| 150,524 | 3/1950 | Australia | 401/209 |
| 1,138,908 | 2/1957 | France | 401/209 |

*Primary Examiner*—Lawrence Charles
*Attorney, Agent, or Firm*—Sherman & Shalloway

[57] ABSTRACT

A ball point pen cartridge comprising an elongated tube having one end open, a socket mounted in the other, a ball rotatably mounted in the socket, a marking fluid within the tube in contact with the ball and means for hermetically sealing the other end of the tube with a hydraulic seal while exerting pressure on the fluid.

8 Claims, 12 Drawing Figures

BALLPOINT PEN CARTRIDGE

BACKGROUND OF THE INVENTION

This invention relates to a ball point pen cartridge including a source of pressure on the marking fluid or ink. More particularly, this invention relates to a ball point pen cartridge wherein the cartridge tube is sealed at the same time as pressure is applied to the ink in the tube.

Although the utilization of pressure within an ink cartridge so as to insure complete emptying of the ink and contact with the ball is well known, the various systems for accomplishing such pressurizing of the ink cartridge have not been completely successful. These prior marking implements utilize some type of hermetic sealing of the end of the cartridge opposite the marking point, such hermetic sealing often being a plug of rigid or elastic substance, Furthermore, the pressure exerted on the marking fluid or ink within the cartridge is often provided either by the reaction of a chemical compound within the cartridge subsequent to sealing or the vapor pressure of the gas of a liquified propellant type material. In these instances, the ball point marking instrument is permanently sealed under appropriate pressure; however, each of these types of marking implements utilizing a gas generating compound and hermetic sealing presents various difficulties as to functioning and manufacture.

In prior pressurized ball point pen ink cartridges, the gas generating or pressurized space at the rear of the cartridge is quite small and initially a relatively high pressure (preferably several atmospheres) is required. It is very important from the standpoint of long term stability that the pressure within this cartridge be maintained permanently. Since the amount of propellant or pressurant within the cartridge is quite small, any amount of leakage, no matter how small, could detrimentally effect the performance of the cartridge in view of the fact that the marking fluid itself is usually specially formulated for use with a pressurized type system.

Furthermore, the manufacture of these pressurized cartridges requires complex and sophisticated apparatus since the cartridge itself must be sealed while the same is pressurized or complex inserting apparatus or separating apparatus must be provided so as to maintain the various chemical reactants separate from each other until the desired time.

Also, the sealing of these cartridges has not been satisfactorily achieved since materials which are completely impermeable to gases are not sufficiently elastic to permit sufficient sealing of the marking instrument so as to ensure a permanent and absolute pressure seal. Furthermore, elastic materials which may easily be fitted into the cartridge tubes with adequate gas tightness are not completely impermeable to gases and the gases tend to escape through the sealing plug during storage. Also, these type processes do not allow for the mass production of implements having great uniformity since the pressure within individual cartridges may vary widely depending upon the tightness of the seal, the amount of pressurant inserted within the cartridge and the time lapse between pressurization and sealing.

The methods of sealing in such pressure hitherto known all involve dry joints between the cartridge tube and a plug which may be simple or of some complexity. Such dry joints, especially when mass-produced, do not assure with certainty perfect and permanent gas-tightness. In the case of joints involving metals, the slightest surface imperfection, for instance a microscopically small scratch on the inside wall of the cartridge at the location of the joint, or on the plug wall, will usually lead to leakage of the compressed gas which will ultimately render the cartridge unusable. Elastic materials suitable for such plugs are not entirely impermeable to gases and will therefor allow a gradual loss of pressure.

BRIEF DESCRIPTION OF THE INVENTION

It is within the above environment and background that the ball point pen cartridge of the present invention was developed.

Briefly, the ball point pen cartridge of the present invention, which can be mass-produced without utilization of special, sophisticated and costly devices and/or operations, comprises an elongated tube having each end open, a ball point mounted in one end of the tube, a marking fluid within the tube in contact with the ball of the ball point and means for simultaneously hermetically sealing the other end of the tube and exerting pressure on the fluid, both during and subsequent to sealing.

It is, therefore, the primary object of the present invention to provide a pressurized ball point pen cartridge which may be simply and efficiently manufactured and maintain this pressure during long periods of storage.

It is a further object of the present invention to provide a pressurized ball point pen cartridge wherein the cartridge is simultaneously pressurized and hermetically sealed.

It is a still further object of the present invention to provide a ball point pen cartridge wherein the sealing means and pressurizing means comprises a hollow plug which is inserted into the pen end of the cartridge entrapping a predetermined amount of gas within the cartridge and ensuring an absolutely tight seal.

It is an additional object of the present invention to provide a pressurized ink cartridge wherein the hermetic seal is maintained by allowing a small amount of marking ink to form a seal between the plug inserted into the cartridge and the cartridge wall itself.

Still further objects and advantages of the ball point pen cartridge of the present invention will become more apparent from the attached drawings and the following detailed description thereof.

DESCRIPTION OF THE PREFERRED EMBODIMENTS

Figure 1:
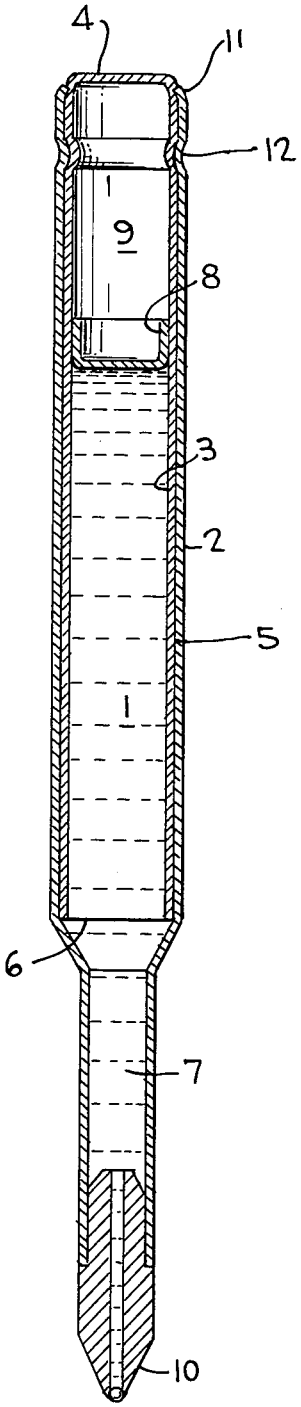
FIG. 1 is a longitudinal section of a cartridge in accordance with the present invention.

As shown in FIG. 1, the cartridge of the present invention has an outer tube or tubular body 2 which serves as a reservoir for marking fluid column 1. The cartridge as shown in FIG. 1 has a narrower portion 7 near marking point 10. Body 2 is closed or sealed by inserting an inner tube 3 into the opened end 11 of body 2. Closing tube 3 has a closed end 4 and an opened end 6 and has an outside diameter corresponding to the inside diameter of tubular body 2. Tube 3 is inserted into body 2 at open end 11 so that open end 6 penetrates into the marking fluid column 1 until end 6 is close to narrow portion 7 of cartridge 2.

It may, however, when so desired be shorter, so that its open end 6 penetrates into the marking fluid only a short distance; or it may be inserted into body 2 only partially until its open end 6 penetrates into the marking fluid for a desired distance, its closed end being left to protrude from the open end of body 2. Also, the closed end of tube 3 may have any desired thickness.

Tube 3 will normally consist of one piece that can, for instance, be deep-drawn, or machined from solid round stock on an automatic screw machine, or injection-moulded or prepared in any other suitable conventional method. It can also be produced from a tube open at both ends, one end being then closed by a welding process. Absolute air tightness can still be guaranteed because such a welded piece can be reliably tested for gas tightness prior to assembly of the marking instrument.

As tube 3 is inserted into body 2, marking fluid 1 penetrates into the tube and also into the interstice 5 between body 2 and tube 3 so as to ensure absolute gas tightness. When tube 3 is completely inserted into body 2, it may be sealed in place by any suitable mechanical means, such as crimp 12. Furthermore, tube 3 may also include a piston 8 which slides within tube 3 so as to insure the stability of marking fluid column 1 in all positions of the cartridge.

The pressure within the pressure space 9 above piston 8 or directly above marking fluid column 1 can be determined with good accuracy by a consideration of the volumes of air spaces contained in the insert tube 3 and in body 2 above marking fluid column and piston 8 (when used), prior to the insertion of tube 3 into body 2, and by consideration of the volume of pressure space 9 after insertion of tube 3 in its final position, which insertion also results in a calculable rise in the level of the marking fluid column 1. Accordingly, by predetermining the dimensions of body 2 and tube 3 and the level of the marking fluid column 1, the initial pressure in space 9 can be predetermined with sufficient accuracy and in a reproducible manner, and from these initial volumes of pressure space and ink volume and initial pressure, the residual pressure at any given subsequent level of the marking fluid column can be calculated.

As may be readily evident, the liquid seal created between the walls or portions thereof of the body 2 and tube 3 remains intact even after, through ink consumption, the ink level descends below the open end of tube 3, and the pressure in a then enlarged pressure space 9 remains perfectly contained although diminished due to the enlargement of the pressure space corresponding to the volume of marking fluid consumed.

Figure 2:
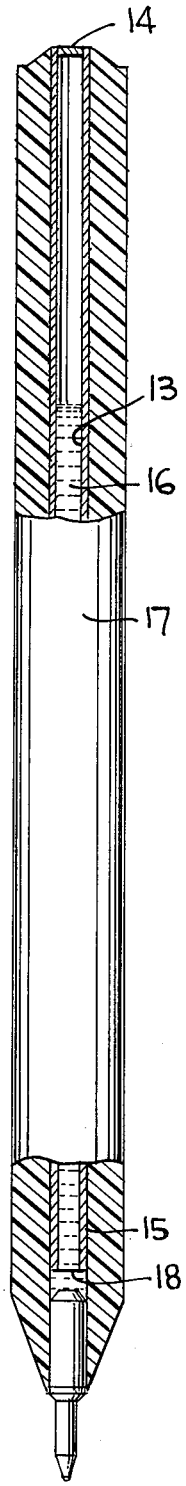
FIG. 2 represents a side view partially broken away of a second embodiment of the cartridge of the present invention.

In FIG. 2, a second embodiment of the pen cartridge of the present invention is set forth. In this embodiment, an elongated tube 13 is inserted into a cartridge body 17 containing a column of marking fluid or ink 16. Tube 13 has a closed end 14 and an opened end 18 so that upon insertion into body 17, the marking ink 16 is forced between body 17 and tube 13 as indicated in space 15. Again, tube 13 may be secured in body 17 by any known conventional securing means.

Figure 3:
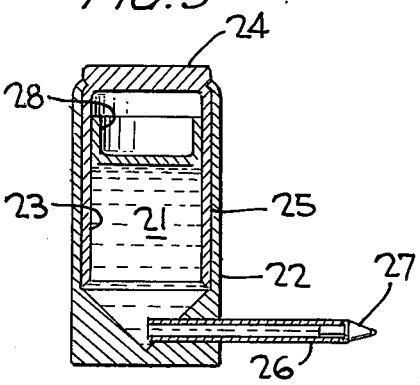
FIG. 3 is a longitudinal section of a ball pen marking implement utilized as a recording instrument.

FIG. 3 shows a further embodiment of the apparatus of the present invention wherein the cartridge is utilized in a recording instrument, such as a temperature, pressure or similar gauge. In this embodiment, the marking ink 21 is contained within a reservoir 22 which has a tube 26 attached thereto in communication with the interior of reservoir 22. Tube 26 also includes a marking tip 27 of a conventional design. Inserted within reservoir 22 is a body 23 which includes a sealing element 24 at the upper end. Also, within tube 23 is a piston 28 which maintains the level of the marking fluid 21 stable. Upon insertion of body 23 into reservoir 22, the marking fluid 21 is forced into interstice 25 between tube 23 and reservoir 22.

Figure 4:
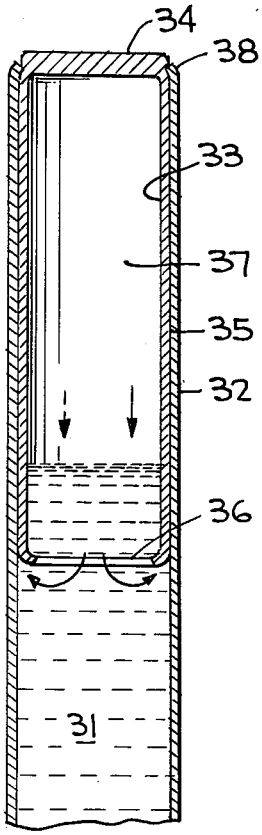
FIG. 4 utilizes a partial view of a third embodiment of the implement of the present invention.

FIG. 4 shows the top portion in cross-sectional view of a fourth embodiment of the marking cartridge of the present invention. In this embodiment, the marking ink or fluid 31 is contained in tubular body 32. Inserted within tubular body 32 is closing tube 33 having a closed end 34 and an opened end 36. Upon forcing closing tube 33 into the end of tubular body 32, the marking fluid 31 is forced partially between the walls of body 32 and tube 33 as shown at 35. Furthermore, the pressure within pressure space 37 forces the fluid 31 toward the marking tip, not shown. Also, tubular closing element 33 is held in place in tubular body 32 by any suitable mechanical attaching means, such as crimp 38.

Figure 5:
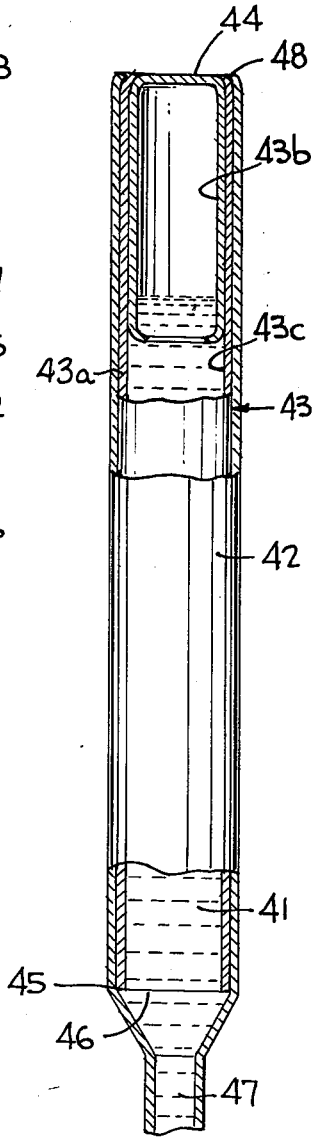
FIG. 5–7 are partial views of alternative embodiments of the cartridge of the present invention.

FIG. 5 shows a still further embodiment of the marking cartridge of the present invention wherein a two-part closing element 43 is inserted into tubular body 42 which contains a reservoir of ink 41. Tubular closing element 43 includes a main portion 43*a* which has an opened end 48 into which is inserted a second closing element 43*b* having a closed end 44. First element 43*a* has an opened end 46 which is inserted into body 42 so that the same is near reduced diameter area 47. In operation, the combined closing tube 43 including both portions 43*a* and 43*b* is inserted into tubular body 42 so that the ink 41 within tubular body 42 is forced into the interstice 45 between tubular body 42 and closing tube 43.

Figure 6:
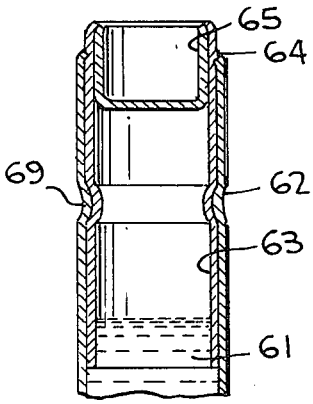
Figure 6A:
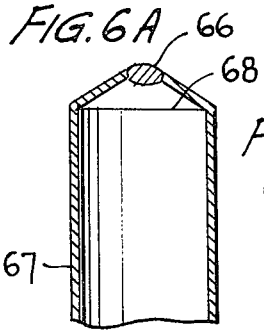

FIGS. 6 and 6a show still further embodiments of the closing tube and marking cartridge of the present invention. FIG. 6 shows an alternative embodiment of the closing element of the present invention with closing element 63 including a closed end 65 attached to tubular closing element 63 by solder or similar mechanical welding means. Again, this tube 63 is inserted into tubular body 62 and sealed in place by any suitable mechanical means, such as crimp 69. Furthermore, FIG. 6a shows the sealing by welding or soldering 66 of the closed end 68 of a closing tube 64 which is designed to be inserted into a tubular body to form the marking cartridge of the present invention.

Figure 7:
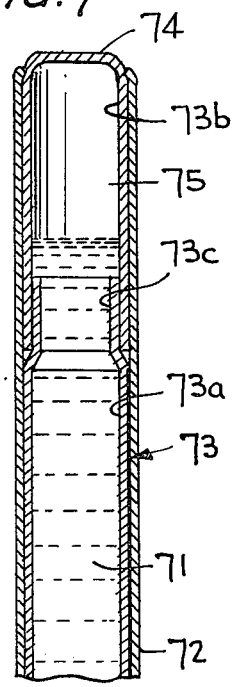

FIG. 7 shows a still further embodiment of the marking cartridge of the present invention wherein ink supply 71 is maintained within tubular body 72 and closing tube 73 consisting of two elements 73*a* and 73*b*. First element 73*a* of closing tube 73 has an upper end having a reduced diameter 73*c* while the outside diameter of first element 73*a* and the second element 73*b* are essentially the same, this diameter being essentially equal to the inside diameter of body 72. Second element 73*b* also has a closed end 74 so that when element 73*b* is forced into section 73*c* of first element 73*a*, a gas tight seal is formed creating pressure within area 75.

In each of the embodiments as illustrated in FIGS. 1–7, the tubular closing element is forced into the tubular body in a manner such that the tubular closing element is partially immersed into the ink supply, thereby creating a liquid type gas seal. While this represents a preferred embodiment of the marking pen cartridge of the present invention, the gas seal may also be effectively maintained if certain precautions and constructions are utilized so as to prevent the leakage of the pressurant gas of an extended storage.

Figure 8:
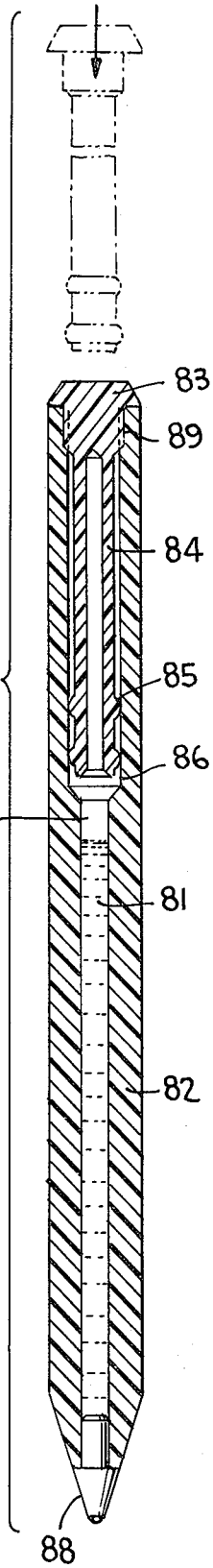
FIG. 8 is a longitudinal section of a further embodiment of the apparatus of the present invention wherein a dry seal is formed.
Figure 9:
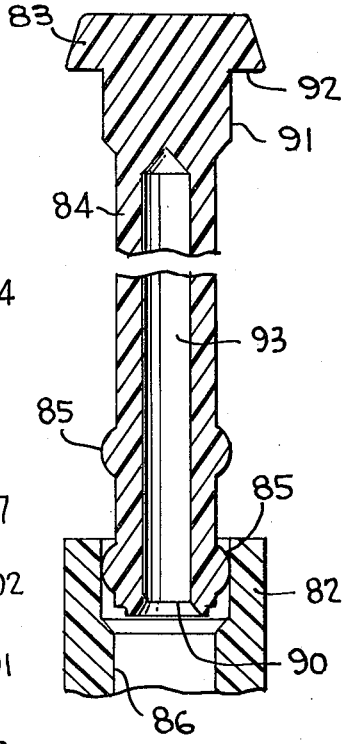
FIG. 9 is a longitudinal partial view of the plug utilized for sealing in the embodiment shown in FIG. 8.

FIGS. 8 and 9 show an embodiment of the present invention wherein the closing tube or plug is not immersed into the ink reservoir and does not utilize the ink itself to form a seal in order to prevent gas from escaping from the cartridge. In FIG. 8, which is a cross-sectional view of a marking cartridge in accordance with the present invention, an ink supply 81 is maintained in a tubular body 82. Tubular body 82 includes a marking point or ball tip 88 which comprises a socket having a ball rotatably mounted in the socket, the surface of the ball being in communication with ink supply 81. Near the end of tubular body 82 away from marking point 88 is a wall of increased diameter 86 as opposed to the inner diameter 87 wherein the ink supply is kept. Furthermore, above wall 86 is a still further surface of increased diameter 89 so that when closing plug 83 is inserted into the tubular body, a pressure type seal is produced.

As is shown in FIG. 9, closing plug 83 comprises a wall section 84 and a series of circumferential protrusions or lips 85 near the open end 90 of plug 83. Furthermore, plug 83 includes a shoulder 91 which fits within surface 89 having increased diameter, as well as a flange 92 which completely covers the top of the body 82.

As plug 83 is inserted into the top or opened end of body 82, protuberances or lips 85 engage the inner wall of body 82 at area 89. As plug 83 is forced downwardly into body 82, the protuberances 85 of plug 83 engage the side wall 86 so that when plug 83 is firmly seated in the top of body 82, a seal is formed between lips 85 and inside wall 86 of body 82 and between surface 91 and surface 89 as well as flange 92 of plug 83.

On insertion, the air within interior chamber 93 is trapped within body 82 of the marketing cartridge thereby providing pressurizing means for the cartridge since the engagement of lips 85 and surface 89 at first and wall 86 later firmly seals the air contained within plug 83 so as to create a compression space within chamber 93.

Figure 10:
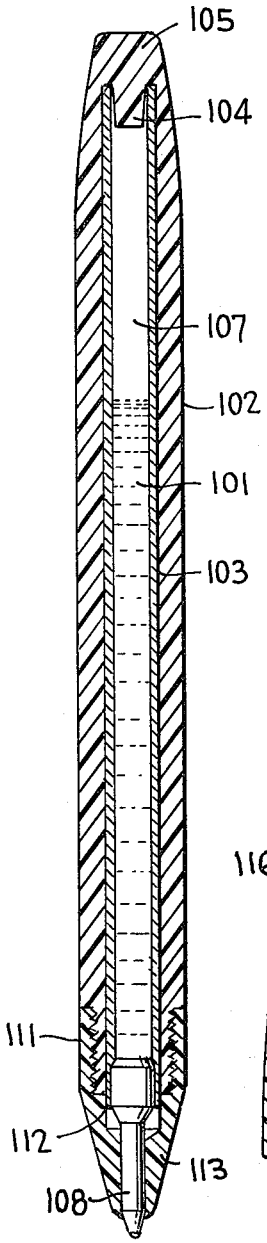
FIG. 10 is a longitudinal side view of a further embodiment of the cartridge of the present invention.

As shown in FIG. 10, which illustrates a further embodiment of the marking cartridge of the present invention wherein no liquid gas type seal is formed, the ink supply 101 is maintained within a reservoir 103 which is designed to be inserted into cartridge body 102. The inside diameter of body 102 and outside diameter of reservoir 103 are essentially the same so that a dry joint is formed as reservoir 103 is inserted into body 102 thereby trappng the gas previously contained within body 102 to form a pressure chamber 107. As reservoir 103 is slid into body 102, it enages a conical plug 104 located on the inside of the closed end 105 of body 102. Plug 104 firmly seals and traps the gas within reservoir 103 thereby insuring that a pressure tight seal is formed. In order that reservoir 103 will not be ejected by the gas pressure in pressure zone 107 from body 102, body 102 is provided with a screw thread 111 which engages a ferrule 113. Furthermore, ferrule 113 includes a shoulder 112 which contacts reservoir 103 at marking element 108.

Figure 11:
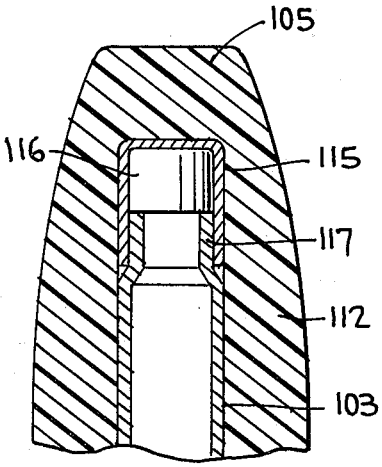
FIG. 11 is a partial side view of a still further embodiment of the cartridge of the present invention.

FIG. 11 shows an alternative closing configuration of the embodiment as shown in FIG. 10 wherein conical element 104 is replaced by elastic plug 116 which is seated in metal sleeve 115 which contacts upper end 117 of reservoir 103, upper end 117 having a reduced diameter so that a pressure tight seal is formed.

Furthermore, with regard to the cross-section of the cartridge of the present invention, it should be noted that the tubular elements which are utilized need not have a round cross-section but may have any suitable cross-section, such as an oval, hexagonal or other configuration, provided the appropriate inside and outside elements are sufficiently, precisely matched so as to slide and fit into one another and so that the tubular element holding the marking tip be shaped so that there is no possibility of fluid leaking out between the tube and the tip. For the most part, however, most of the practical applications of the marking cartridge of the present invention will have a round configuration and cross-section.

Furthermore, as the marking fluid utilized in the marking cartridge of the present invention it is desired to utilize a marking fluid paste having a high viscosity with high cohesive and adhesive and film-forming characteristics, such as described in U.S. Pat. No. 3,659,951. The marking ink disclosed in this patent consists of a mixture of at least one slowly volatile or evaporating solvent and at least one rapidly evaporating solvent as well as at least one or more dyes and thickners.

The foregoing description of the marking pen cartridge of the present invention has been for the purposes of illustration only and is in no way to be deemed as limiting the cartridge of the present invention, which cartridge is properly defined by way of the following appended claims.

What is claimed is:

1. A ball point marking instrument comprising an outer tube having each end open, a ball point registered adjacent to one end of said outer tube, a marking liquid within said outer tube, said marking liquid in contact with the ball of said ball point, and an inner tube having one open end and one closed end and initially containing a gas, said inner tube being inserted into sealing relation with said outer tube to a depth at which the open end penetrates said marking liquid so that the gas within said inner tube is compressed in a space between said marking liquid and said closed end to exert pressure on said marking liquid and to thereby force said marking liquid against said ball point.

2. The ballpoint marking instrument of claim 1 wherein said inner tube is longer than the space above said marking liquid in said outer tube so that upon insertion of said inner tube into said outer tube, said marking liquid penetrates into the interstice between the outer tube and the inner tube forming a hydraulic hermetic seal.

3. The ball point marking instrument of claim 1, wherein the ball point is registered with the inner tube via a lateral tube which projects from the outer tube at an angle with the axis thereof.

4. The ball point marking instrument of claim 1, wherein the outer tube is elongated.

5. The ball point marking instrument of claim 1, wherein a piston is telescoped within the inner tube and is disposed between the space containing the compressed gas and the marking liquid.

6. The ball point marking instrument of claim 1, wherein the compressed gas is air.

7. The ball point marking instrument of claim 1, wherein the outer diameter of the inner tube closely approximates the inner diameter of the outer tube so as to form a hermetic seal therebetween.

8. The ball point marking instrument of claim 1, wherein the inner tube is held within the outer tube by crimping at least the outer tube to overlie a portion of the inner tube.

* * * * *